US008761646B2

(12) United States Patent
Barton et al.

(10) Patent No.: US 8,761,646 B2
(45) Date of Patent: Jun. 24, 2014

(54) APPARATUSES USEFUL FOR PRINTING AND CORRESPONDING METHODS

(75) Inventors: Augusto E. Barton, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1090 days.

(21) Appl. No.: 12/409,082

(22) Filed: Mar. 23, 2009

(65) Prior Publication Data

US 2010/0239350 A1 Sep. 23, 2010

(51) Int. Cl.
*G03G 15/20* (2006.01)

(52) U.S. Cl.
USPC ..... 399/323; 399/304; 399/305; 399/329

(58) Field of Classification Search
USPC ..... 399/323, 329, 304, 305
See application file for complete search history.

(56) References Cited

U.S. PATENT DOCUMENTS

| | | | | | |
|---|---|---|---|---|---|
| 3,923,298 | A * | 12/1975 | Ishida | 271/312 |
| 4,000,942 | A * | 1/1977 | Ito et al. | 399/398 |
| 5,130,758 | A * | 7/1992 | Takeda et al. | 399/304 |
| 5,517,292 | A * | 5/1996 | Yajima et al. | 399/323 |
| 5,543,908 | A * | 8/1996 | Suzuki | 399/398 |
| 5,634,404 | A * | 6/1997 | Okuda | 101/477 |
| 5,882,124 | A * | 3/1999 | Diemer et al. | 384/570 |
| 5,911,100 | A * | 6/1999 | Hasegawa et al. | 399/303 |
| 6,049,393 | A * | 4/2000 | Knierim et al. | 358/1.2 |
| 6,164,432 | A * | 12/2000 | Monsees | 198/459.4 |
| 6,736,500 | B2 * | 5/2004 | Takahashi et al. | 347/103 |
| 7,073,436 | B2 * | 7/2006 | Takahashi | 101/229 |
| 7,086,713 | B2 * | 8/2006 | Triplett | 347/16 |
| 2006/0210331 | A1 | 9/2006 | Baba et al. | |
| 2007/0048035 | A1 | 3/2007 | Baba et al. | |
| 2007/0048042 | A1 | 3/2007 | Uehara et al. | |
| 2007/0092277 | A1 | 4/2007 | Miyata et al. | |
| 2007/0166084 | A1 | 7/2007 | Yoshino et al. | |
| 2007/0172272 | A1 | 7/2007 | Miyata et al. | |
| 2008/0037069 | A1 | 2/2008 | Mestha et al. | |
| 2010/0232848 | A1 * | 9/2010 | Naitoh | 399/323 |

FOREIGN PATENT DOCUMENTS

JP 2007078090 A * 3/2007

* cited by examiner

*Primary Examiner* — David Banh
(74) *Attorney, Agent, or Firm* — Ronald E. Prass, Jr.; Prass LLP

(57) ABSTRACT

Apparatuses useful for printing and methods of stripping media from surfaces in apparatuses useful for printing are provided. An exemplary embodiment of an apparatus useful for printing includes a first roll, a belt including an inner surface and an outer surface, the first roll and the outer surface of the belt forming a nip, and a stripping member located internal to the belt. The stripping member includes a first needle bearing, wherein the first needle bearing contacts with the inner surface of the belt to facilitate stripping of media fed to the nip from the outer surface of the belt.

8 Claims, 5 Drawing Sheets

APPARATUSES USEFUL FOR PRINTING AND CORRESPONDING METHODS

BACKGROUND

In some printing apparatuses, images are formed on media using a marking material. Such printing apparatuses can include a roll and a belt that define a nip. Media are fed to the nip and heated to treat the marking material. The media is typically stripped from the belt.

It would be desirable to provide apparatuses useful for printing and methods that can strip media from surfaces efficiently.

SUMMARY

Apparatuses useful for printing and methods of stripping media from surfaces in apparatuses useful for printing are provided. An exemplary embodiment of an apparatus useful for printing includes a first roll, a belt including an inner surface and an outer surface, the first roll and the outer surface of the belt forming a nip, and a stripping member located internal to the belt. The stripping member includes a first needle bearing, wherein the first needle bearing contacts with the inner surface of the belt to facilitate stripping of media fed to the nip from the outer surface of the belt.

DRAWINGS

DETAILED DESCRIPTION

The disclosed embodiments include an apparatus useful for printing. The apparatus includes a first roll, a belt including an inner surface and an outer surface, the first roll and the outer surface of the belt forming a nip, and a stripping member located internal to the belt, the stripping member including a first needle bearing, wherein the first needle bearing contacts with the inner surface of the belt to facilitate stripping of media fed to the nip from the outer surface of the belt The disclosed embodiments further an apparatus useful for printing. The apparatus includes a first roll, a second roll, a belt disposed between the first roll and second roll, the belt including an inner surface and an outer surface, and a stripping member located between the second roll and the inner surface of the belt, the stripping member having a first surface facing the inner surface of the belt, and the stripping member having a second surface facing the second roll, wherein the first surface of the stripping member includes a first needle bearing contacting the inner surface of the belt, and the second surface of the stripping member includes at least one second needle bearing contacting the second roll.

The disclosed embodiments further include a method of stripping a medium from a surface in an apparatus useful for printing, the apparatus comprising a first roll, a belt including an inner surface and an outer surface, and a nip formed by the first roll and the outer surface of the belt. The method includes contacting the medium with the outer surface of the belt at the nip, and stripping the first medium from the belt using the stripping member, the stripping member including a first needle bearing, wherein the first needle bearing contacts with the inner surface of the belt to facilitate stripping of medium from the outer surface of the belt.

As used herein, the term "printing apparatus" encompasses any apparatus that performs a print outputting function for any purpose. Such apparatuses can include, e.g., a digital copier, bookmaking machine, multifunction machine, and the like. The printing apparatuses can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

As used herein, the term "needle bearing" encompasses a cylindrical roller having a substantially circular cross section useful in reducing friction of a rolling or moving device.

Figure 1:
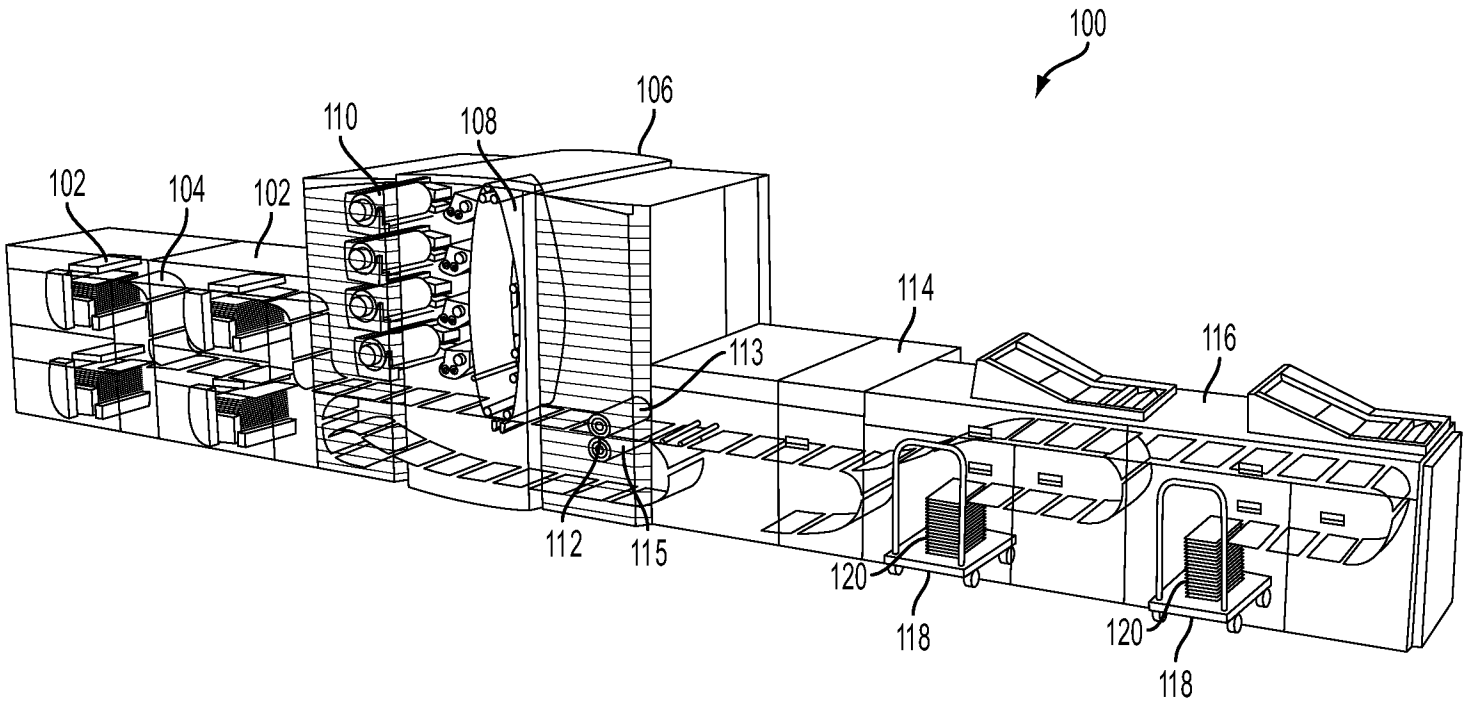
FIG. 1 depicts an exemplary embodiment of a printing apparatus.

FIG. 1 illustrates an exemplary printing apparatus 100 as disclosed in U.S. Patent Application Publication No. 2008/0037069, which is incorporated herein by reference in its entirety. The printing apparatus 100 can be used to produce prints with different media types.

The printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114. In the printing apparatus 100, the media feeder modules 102 feed media to the printer module 106. In the printer module 106, toner is transferred from a series of developer stations 110 to a charged photoreceptor belt 108 to form toner images on the photoreceptor belt 108 and produce color prints. The toner images are transferred to respective media 104 fed through the paper path. The media are advanced through a fuser 112 including a fuser roll 113 and pressure roll 115, which form a nip where heat and pressure are applied to the media to fuse toner images onto the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Apparatuses useful for printing and methods of stripping media in apparatuses useful for printing are provided. Embodiments of the apparatuses are constructed to treat marking material on different media types. Embodiments of the apparatuses include a belt. The belt can be heated to supply thermal energy to media.

Figure 2:
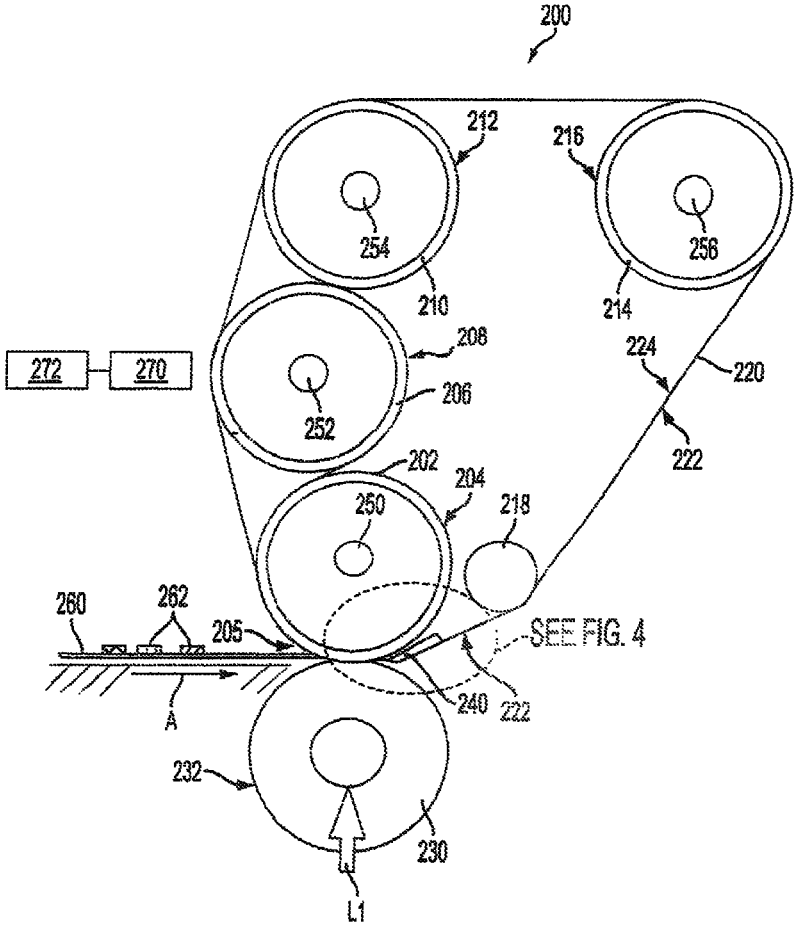
FIG. 2 depicts an exemplary embodiment of a fuser used to treat a thin medium.

FIG. 2 illustrates an exemplary embodiment of an apparatus useful for printing. The apparatus is a fuser 200. The fuser 200 is constructed to facilitate stripping of different media types that may be used in the fuser 200. Embodiments of the fuser 200 can be used with different types of printing apparatuses. For example, the fuser 200 can be used in place of the fuser 112 in the printing apparatus 100 shown in FIG. 1.

As shown in FIG. 2, the fuser 200 includes a continuous belt 220 provided on a fuser roll 202, external roll 206, internal rolls 210, 214 and an idler roll 218. The belt 220 has an outer surface 222 and an inner surface 224. In other embodiments, the fuser 200 can include less than, or more than, four rolls supporting the belt 220.

The fuser roll 202, external roll 206 and internal rolls 210, 214 have outer surfaces 204, 208, 212 and 216, respectively, contacting the belt 220. The fuser roll 202, external roll 206 and internal rolls 210, 214 include internal heating elements 250, 252, 254 and 256, respectively. The heating elements 250, 252, 254 and 256 can be, e.g., axially-extending lamps. The heating elements are connected to a power supply 270 in a conventional manner. In embodiments, each of the fuser roll 202, external roll 206, and internal rolls 210, 214 can include more than one heating element. For example, each of these rolls can include one long lamp and one short lamp. The power supply 270 is connected to a controller 272 in a conventional manner. The controller 272 controls the operation of the power supply 270 to control the supply of voltage to the heating elements 250, 252, 254 and 256, so as to heat the belt 220 to the desired temperature.

The fuser 200 further includes an external pressure roll 230 having an outer surface 232, which is shown engaging the belt 220. The pressure roll 230 and belt 220 forms a nip 205 between the outer surface 232 and the outer surface 222. In embodiments, the pressure roll 230 includes a core and an outer layer with the outer surface 232 overlying the core. The core can be comprised of aluminum or the like, and the outer layer can be comprised of an elastically deformable polymeric material.

Embodiments of the belt 220 can include, e.g., a base layer, an intermediate layer on the base layer, and an outer layer on the intermediate layer. In such embodiments, the base layer forms the inner surface 224 and the outer layer forms the outer surface 222 of the belt 220. In an exemplary embodiment of the belt 220, the base layer is comprised of a polymeric material, such as polyimide, or the like; the intermediate layer is comprised of silicone, or the like; and the outer layer is comprised of a polymeric material, such as a fluoroelastomer sold under the trademark Viton® by DuPont Performance Elastomers, L.L.C., polytetrafluoroethylene (Teflon®), or the like.

In embodiments, the belt 220 can have a thickness of about 0.1 mm to about 0.6 mm. For example, the belt 220 can include a base layer having a thickness of about 50 μm to about 100 μm, an intermediate layer having a thickness of about 100 μm to about 500 μm, and an outer layer having a thickness of about 20 μm to about 40 μm. The belt 220 can typically have a width of about 350 mm to about 450 mm, and a length of about 500 mm to at least about 1000 mm.

FIG. 2 depicts a medium 260 being fed to the nip 205 in the process direction A. The fuser roll 202 is rotated counter-clockwise and the pressure roll 230 is rotated clockwise to convey the medium 260 through the nip 205 in the process direction A and rotate the belt 220 counter-clockwise. The medium 260 can be, e.g., a paper sheet. Typically, paper is classified by weight. Light-weight paper has a weight of ≤about 75 gsm, medium-weight paper has a weight of about 75 gsm to about 160 gsm, and heavy-weight paper has a weight of ≥160 gsm. Typically, a low toner mass is less than about 0.8 mg/cm$^2$, while a high toner mass is at least about 0.8 mg/cm$^2$. Media can be coated or uncoated. A larger amount of energy (both per thickness and per basis weight) is used to treat marking material on coated media as compared to uncoated media. For example, a higher fusing temperature is used to fuse toner on heavy-weight media as compared to light-weight media.

The outer surface 232 of the pressure roll 230 is deformed by contact with the belt 220 on the fuser roll 202. The outer surface 204 of the fuser roll 202 may also be deformed by this contact depending on the hardness of the material forming the outer surface 204. For example, when the outer surface 204 is made of an elastically deformable material, the outer surface 204 can also be deformed by contact with the pressure roll 230.

The "nip width" is the distance between the nip entrance and the nip exit in the process direction. The nip width can be expressed as the product of the dwell and process speed (i.e., nip width=dwell×process speed). FIG. 2 depicts a case where the medium 260 fed to the nip 205 is a light-weight medium, such as light-weight paper. A marking material 262, e.g., toner, is on a top surface of the medium 260 facing the belt 220. The medium 260 can be coated or uncoated. In this case, the belt 220 and pressure roll 230 forms a small nip width.

Figure 3:
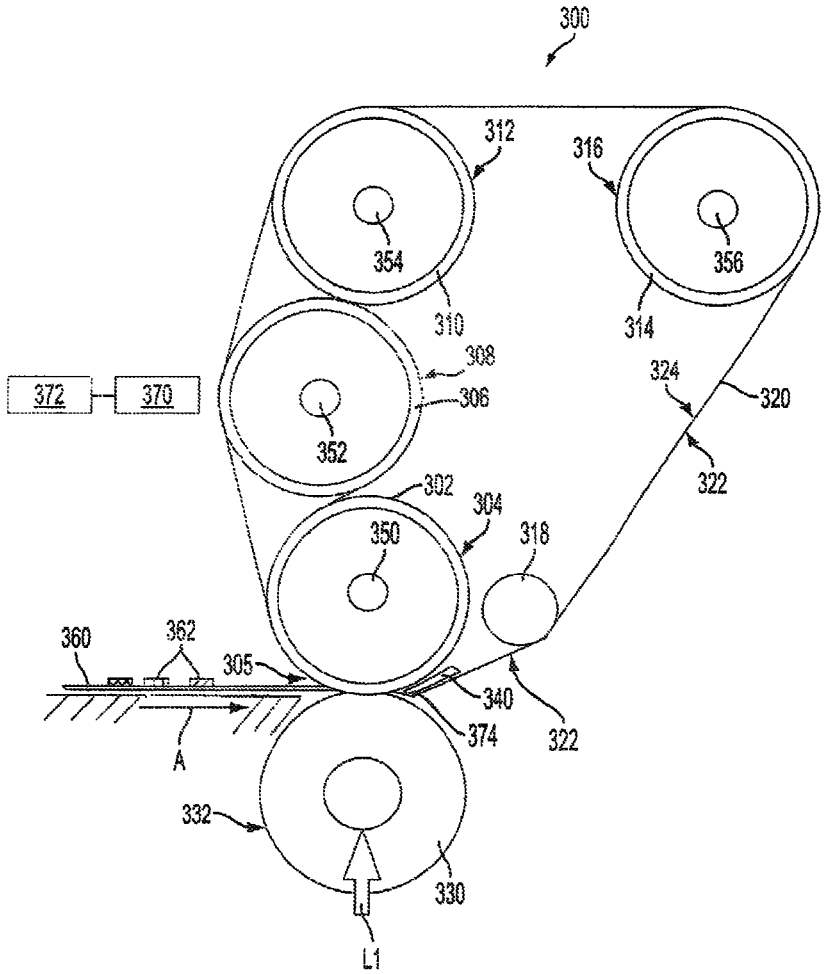
FIG. 3 depicts an exemplary embodiment of a fuser used to treat a thin medium.

FIG. 3 depicts a case where a heavy-weight medium 360, such as heavy-weight paper, is being fed to the nip 305 in the fuser 300. A marking material 362, e.g., toner, is on a top surface of the medium 360 facing the belt 220. The medium 360 can be coated or uncoated. In this case, there is a larger nip width and higher pressure between the belt 320 and pressure roll 330 than for the case of a light-weight medium depicted in FIG. 2.

The fuser 300 includes a continuous belt 320 provided on a fuser roll 302, external roll 306, internal rolls 310, 314 and an idler roll 318. The belt 320 has an outer surface 322 and an inner surface 324.

The fuser roll 302, external roll 306 and internal rolls 310, 314 have outer surfaces 304, 308, 312 and 316, respectively, contacting the belt 320. The fuser roll 302, external roll 306 and internal rolls 310, 314 include internal heating elements 350, 352, 354 and 356, respectively. The heating elements are connected to a power supply 370 in a conventional manner. The power supply 370 is connected to a controller 372 in a conventional manner. The controller 372 controls the operation of the power supply 370 to control the supply of voltage to the heating elements 350, 352, 354 and 356, so as to heat the belt 320 to the desired temperature.

The fuser 300 further includes an external pressure roll 330 having an outer surface 332, which is shown engaging the belt 320. The pressure roll 330 and belt 320 forms a nip 305 between the outer surface 332 and the outer surface 322. In embodiments, the pressure roll 330 includes a core and an outer layer with the outer surface 332 overlying the core. The materials forming the various elements of fuser 300 may be the same as those described in conjunction with fuser 200.

The stripping member 340 is disposed between the inner surface 324 of the belt 320 and the outer surface 304 of the fuser roll 302. The stripping member 340 may include a first needle bearing 374, which may have a circular cross section, and may have a length extending in a direction of an axis of the fuser roll 302. The needle bearing 374 may rotate along its axis, so as to reduce friction on the inner surface 324 of the belt 320. The needle bearing 374 may have a diameter of about 1 mm to 2 mm, and a length of about 8 mm. The needle bearing 374 may be formed from stainless steel or the like.

The needle bearing 374 reduces an area of the stripping member 340 that comes into contact with the inner surface 324 of the belt 320, which reduces wear that would occur on the inner surface 324 of the belt 320 without the presence of the needle bearing. Further, because the needle bearing 374 has a circular cross section and can rotate along its axis, this further reduces wear on the inner surface 324 of the belt 320.

Figure 4:
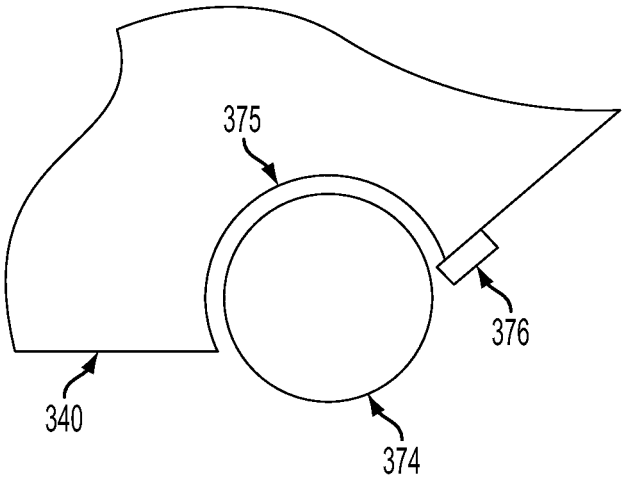
FIG. 4 is an enlarged view of a portion of the fuser shown in FIG. 2.

FIG. 4 illustrates a portion of the fuser 300 including the stripping member 340. The stripping member 340 may include a cutout portion 375 into which the needle bearing 374 may be inserted. The cutout portion 375 may have a size and shape corresponding to a shape of the needle bearing 374. The stripping member 340 may also include a retainer for retaining the needle bearing 374 in the cutout portion 375. The needle bearing 374 may rotate within the cutout portion 375.

Figure 5:
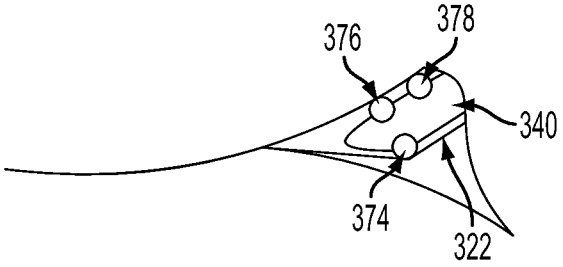
FIG. 5 is an enlarged view of a portion of the fuser shown in FIG. 2.

As shown in FIG. 5, the stripping member 340 may include a first needle bearing 374, as well as at least one second needle bearing, such as needle bearing 376 and needle bearing 378. The needle bearing 374 may be located on a first surface of the stripping member 374, and the needle bearings 376 and 378 may be located on a second surface of the stripping member 340 facing the outer surface 304 of the fuser roll 302.

Embodiments of the stripping members can also be used in apparatuses useful for printing to assist stripping of media from belts that have different structures and functions than fuser belts. For example, the stripping members can be used in printing apparatuses to assist stripping of media from photoreceptor belts used to transfer images to media, and in printing apparatuses to assist stripping of media from intermediate belts used to transport images that are transferred to media. Apparatuses useful for printing can include more than one stripping member for stripping media from more than one belt included in printing apparatuses.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first roll;

a second roll;

a belt disposed between the first roll and second roll, the belt including an inner surface and an outer surface; and a stripping member located between the second roll and the inner surface of the belt, the stripping member having a first surface facing the inner surface of the belt, and a second surface facing the second roll, wherein the first surface of the stripping member includes a first needle bearing rotatably contacting the inner surface of the belt, and the second surface of the stripping member includes at least one second needle bearing rotatably contacting the second roll, and the stripping member includes a plurality of cutout portions formed in the stripping member for holding the first needle bearing and the at least one second needle bearing, the plurality of cutout portions having sizes and shapes corresponding to sizes and shapes of the first needle bearing and the at least one second needle bearing in cross section, respectively, the first needle bearing and the at least one second needle bearing being inserted into the plurality of cutout portions.

2. The apparatus of claim 1, wherein the at least one second needle bearing comprises a plurality of second needle bearings.

3. The apparatus of claim 1, the stripping member further comprising retainers for holding the first needle bearing and the at least one second needle bearing within the plurality of cutout portions.

4. The apparatus of claim 1, wherein the first needle bearing and the at least one second needle bearing have a diameter of about 1 mm.

5. A method of stripping medium from a surface in an apparatus useful for printing, the apparatus comprising a first roll, a second roll, a belt disposed between the first roll and the second roll and including an inner surface and an outer surface, a nip formed by the first roll and the outer surface of the belt, and the second roll contacting the inner surface of the belt in a vicinity of the nip, the method comprising:

contacting the medium with the outer surface of the belt at the nip; and stripping the medium from the belt using a stripping member, the stripping member including (1) a first needle bearing, the first needle bearing rotatably contacting the inner surface of the belt to facilitate stripping of the medium from the outer surface of the belt, (2) a second needle bearing rotatably contacting the second roll, and (3) a plurality of cutout portions for holding the first needle bearing, the plurality of cutout portions having a size and a shape corresponding to a size and a shape of the first needle bearing and the second needle bearing, respectively, in cross section, the first needle bearing and the second needle bearing being inserted into the plurality of cutout portions.

6. The method of claim 5, wherein the stripping member is located about 10 mm from the nip.

7. The method of claim 5, wherein the first needle bearing has a diameter of about 1 mm.

8. The method of claim 5, wherein the stripping member further comprises a plurality of second needle bearings, the plurality of second needle bearings rotatably contacting the second roll.

* * * * *